US007347287B2

(12) United States Patent
Chancey

(10) Patent No.: US 7,347,287 B2
(45) Date of Patent: Mar. 25, 2008

(54) HYDRAULIC TIMING DEVICE

(76) Inventor: Roger Chancey, 19814 Brightstone, Humble, TX (US) 77338

( * ) Notice: Subject to any disclaimer, the term of this patent is extended or adjusted under 35 U.S.C. 154(b) by 202 days.

(21) Appl. No.: 11/241,040

(22) Filed: Sep. 30, 2005

(65) Prior Publication Data

US 2007/0074909 A1 Apr. 5, 2007

(51) Int. Cl.
*E21B 4/14* (2006.01)
*E21B 31/113* (2006.01)

(52) U.S. Cl. ..... 175/297; 175/293; 166/178

(58) Field of Classification Search ..... 175/297, 175/293; 166/178
See application file for complete search history.

(56) References Cited

U.S. PATENT DOCUMENTS 4,023,630 A * 5/1977 Perkin et al. ..... 175/297
4,754,821 A * 7/1988 Swietlik ..... 175/325.4
5,318,139 A * 6/1994 Evans ..... 175/297
5,647,446 A * 7/1997 Wenzel ..... 175/297
6,202,767 B1 * 3/2001 Friis ..... 175/297

* cited by examiner

*Primary Examiner*—David Bagnell
*Assistant Examiner*—Shane Bomar
(74) *Attorney, Agent, or Firm*—O'Neil & McConnell, PLL.; R. Perry McConnell

(57) ABSTRACT

A jar for use in a downhole environment comprises an hydraulic timing device which allows pressure to be controllably increased to a desired level and, on firing, a near-instantaneous release of that pressure, and which allows for selective bi-directional firing of the jar.

27 Claims, 5 Drawing Sheets

HYDRAULIC TIMING DEVICE

FIELD OF THE INVENTION

The invention pertains to jars used in downhole environments to provide an impact force, such as tools used to loosen stuck tool strings or for fishing.

BACKGROUND OF THE INVENTION

Jars, such as hydraulic jars, are used in downhole environments to provide impact force. Such tools are useful when a fishing or drilling string is stuck within a well bore and it is necessary to apply an impact force at the stuck location of the string to attempt to loosen it. Similarly, jars can be used in conjunction with fishing tools to provide the fishing tool with sufficient force for operation, for example, by providing an upward jarring force after the fishing tool has engaged a stuck tool.

Jars may be constructed to provide an impact force in either the "up," or "upward" (toward the surface) or "down," or "downward" (away from the surface) directions. Those of skill in the art will recognize that "up" and "down" are so defined because use of horizontal drilling techniques may result in situations in which "up" and "down" are not vertical. Similarly, as used herein, the "lower" portion of a tool or a part thereof is in the "downward" direction in respect to the "upper" portion. For maximum flexibility, ajar can be constructed to provide bidirectional impact, that is, it can fire (provide impact blows) in either the "up" or "down" directions at the choice of the operator on the surface.

However, in some applications, particularly those using coiled tubing, the length of the tools used is of great importance. With coiled tubing, it is greatly desirable to have shorter tools, because multiple tools must often be assembled in combination at the surface, and the coiled tubing operation does not allow for successive assembly of tools as the string is run into a pressured hole. Accordingly, it is sometimes desirable to use ajar which fires in only one direction, because the needed apparatus is shorter than one designed for bi-directional use.

Jars used in these applications operate by setting, or cocking, the jar, then applying an upward or downward force on the jar. These jars comprise a mandrel, which moves relative to the tool body and which bears the primary impact of the jar. Both the mandrel and the tool body generally have anvil surfaces which form the contact surfaces where the mandrel and the tool body meet. When the tool is released from the set position, the mandrel and the tool body move relative to each other at high speed, and the respective anvil surfaces strike with great force, thus producing the impact force of the jar. The relative direction of travel of the mandrel to the tool body is determined by whether the jar is fired up or down.

Although the operation of such tools provides large impact forces where needed, the result is also a large amount of stress on the jar and its various parts. Accordingly, repeated operations of these tools can result in rapid wear and the need to replace or repair the jar. Because reliability of operation is important, it is desirable that a jar be designed and constructed to accommodate repeated high stress. However, the tools are size-constrained by the standard sizes used for downhole operations and the need for limiting the length of the tool, especially in conjunction with coiled tubing operations. In current jars, these factors have limited the ability of the tool to withstand repeated operations without the need for repair or replacement.

Accordingly, it is a goal of the invention to provide a jar that is substantially shorter than current jars.

It is another goal of the invention to provide a jar with improved capability to withstand repeated operation cycles.

It is a further goal of the invention to provide a jar capable of improved impact force.

SUMMARY OF THE INVENTION

In the preferred embodiment, the invention comprises a hydraulic jar with a mandrel, a spline body, and a hydraulic timing device. The jar comprises an annular tool body, which is mechanically engaged with the spline body at the lower end of the jar. In the preferred embodiment, the spline body is threaded into the tool body. At its lower end, the spline body has a first anvil face which provides an impact surface for operation of the jar when the tool is fired downward. At its upper end, the spline body has a second anvil face which provides an impact surface for operation of the jar when the tool is fired upward.

The mandrel comprises an annular body which is essentially cylindrical, and which extends through the spline body into the tool body. The lower end section of the mandrel forms a first stop, the upper end of which comprises an anvil face for engaging the first anvil face of the spline body. The upper end section of the mandrel forms a second stop, the lower end of which comprises an anvil face for engaging the second anvil face of the spline body. Thus, the mandrel body can slide up and down through the spline body, its travel limited only by the engagement of the first and second stops with the spline body.

In the preferred embodiment, the first stop of the mandrel is a formed portion of the mandrel body, which maximizes the strength of the mandrel. Such maximum strength is desirable due to the force of the impact when the first stop strikes the spline body when the jar is fired. However, the first stop may be made replaceable by making it detachable from the remainder of the mandrel body, as by providing a threaded engagement. In such a case, it is desirable that the threads be radially as far as possible from the longitudinal axis of the jar to avoid undermining the strength of the jar.

The mandrel body comprises a plurality of longitudinal spline slots, which are preferably milled into the outer surface of the mandrel body. Similarly, the spline body comprises a plurality of longitudinal splines which are fittable into the spline slots in the mandrel body. In the preferred embodiment, the spline body comprises a plurality of longitudinal spline slots milled into the inner surface of the spline body which do not extend to either end of the spline body, and splines are set into the spline slots in the spline body. Additionally, in the preferred embodiment, the spline body comprises a plurality of sections, preferably two longitudinal halves, into which the splines could be set and which can then be fitted around the mandrel body with the splines in slideable engagement with the spline slots of the mandrel body. Alternatively, the splines may be manufactured as part of the inner surface of the spline body.

The spline body and the mandrel are preferably of high strength ferrous or stainless steel. A variety of appropriate materials may be used. Those of skill in the art will recognize that some applications, such as drilling applications, will impose higher torques on the device and will thus require stronger splines than will other applications.

In the preferred embodiment, the spline body can be assembled around the mandrel prior to being threaded into the tool body, allowing for a stronger, one-piece mandrel, as well as for ease of assembly and, if necessary, replacement of tool parts while simultaneously avoiding having any internal threaded structures in the impact path. Accordingly, this embodiment provides significant strength advantages and simultaneously provides for ease of maintenance.

As those of skill in the art will recognize, it is possible to make variations of the structure of this device without departing from the spirit of the invention. For example, the spline body could potentially be a cast piece, with the splines extending from the inner surface without the need for milled spline slots or separately formed splines.

The spline body additionally preferably comprises a vent extending from the first anvil face of the spline body, through the spline body, providing fluid communication with the outside of the tool body and the annular space inside of the tool body. In the preferred embodiment, the second stop of the mandrel is formed to allow fluid communication between the volumes above and below it within the tool body, that is, it does not form a seal with the tool body. Also in the preferred embodiment, an annular mandrel extension is threaded into and in sealing engagement with the second stop of the mandrel, and a floater provides a seal in the annular space above the second stop of the mandrel. The floater serves to equalize hydraulic pressure above and below it, so that the hydraulic fluid within the hydraulic timer (discussed below) is not contaminated by fluid from outside the tool, but the pressures between the two fluids are automatically equalized.

In the preferred embodiment, the mandrel extension further extends into an annular piston body, which is in mechanical engagement with the tool body and serves as an extension thereof. The piston body preferably provides the housing for a hydraulic timing device, although other timing devices, such as mechanical devices known to those of skill in the art, could be used.

Prior art hydraulic timing devices sometimes utilize sliding metal-to-metal seals which maintain a sealing engagement with the face of an internal annular body, such as the piston body of the present invention, and a selective sealing engagement with the inside circumference of an external annular body, such as the floater body or pressure body of the present invention. These devices are prepared for firing by first positioning the seal in a sealing engagement with the external annular body by choosing a "vertical" position in which the inside circumference of the external annular body is small enough to engage the seal. The triggering device comprises a fluid channel, which allows a small amount of hydraulic fluid to "leak" around the seal at a known rate, thus allowing the seal to move at a regulated rate relative to the external annular body when tensile or compressive force is applied by the operator at the surface. The fluid channel may be an integral part of the seal, such as a small channel in the seal material, or may otherwise be formed to provide a fluid pathway around the seal. The external annular body is formed with a transition region in which its internal circumference increases beyond the maximum circumference of the seal, so that when the seal reaches this point, the hydraulic seal will be rapidly released and the jar will "fire" in a sudden release of applied force.

In the preferred embodiment of the present invention, a sliding metal-to-metal seal is in sealing engagement with the face of the floater body or the pressure body, and in selective sealing engagement with the outer circumference of the mandrel extension. In the preferred embodiment, the selective sealing engagement is accomplished by shaping the mandrel extension so that its outer circumference varies, to provide a region of sufficient circumference to engage the sliding metal-to-metal seal, and a region of insufficient circumference to engage the seal. The device is set for firing by positioning it so that the seal is engaged with the outer circumference of the mandrel extension, then applying tensile or compressive force to the assembly. A fluid channel is provided to allow a controlled "leak" of hydraulic fluid around the seal, allowing the seal to slide in a controlled fashion to the point at which the outer circumference of the mandrel extension slopes inward and the seal is released. Those of skill in the art will recognize that the timing of the device can be altered, for example by changing the size of the fluid channel or the length of the section of the mandrel extension which provides sealing engagement with the sliding seal.

Providing a sliding seal which springs inward greatly enhances the strength of the device, because the floater body and the pressure body are of uniform thickness. In the prior art, the thickness of the floater body or pressure body had to decrease at the point at which the seal would release, and remain at this decreased thickness for the length of travel of the mandrel, so that the seal would not catastrophically re-engage with the inner circumference of the floater body or pressure body. Maintaining a uniform thickness of the floater body or pressure body prevents a "weak spot" in the wall of the floater body or pressure body due to the inverse relationship of the hoop stress to the wall thickness.

If a bi-directional jar is desired, a second sliding seal may be incorporated into the hydraulic timing mechanism, preferably oriented in the opposite longitudinal direction from the first sliding seal. The overall length of the mechanism can be limited by tapering the outer circumference of the mandrel extension at two locations, forming a "bulge" in the outer circumference which engages one of the two seals when tensile force is applied, and the other of the two seals when compressive force is applied. Those of skill in the art will recognize that it is mechanically possible to provide a bi-directional jar with multiple seals which are oriented in the same longitudinal direction, so long as the fluid flow through the respective fluid channel for each seal is appropriately directed. At some sacrifice of increased tool length, the jar can also be made bi-directional utilizing a single seal and a plurality of tapers on the outer circumference of the mandrel extension separated by sufficient distance to allow the jar to fully travel in either direction.

Those of skill in the art will also recognize that the hydraulic timing device of the present invention may be used independently of the spline body and mandrel combination described herein as part of the preferred embodiment of the device.

Those of skill in the art will further recognize that terms such as "mandrel extension," "piston body," and the like are for convenience only, and that a variety of single- or multi-part assemblies may be utilized in place of these parts without departing from the spirit of the invention.

As described above, the jar of the present invention can be used with greater firing loads than similarly sized current jars.

DETAILED DESCRIPTION

Figure 1A:
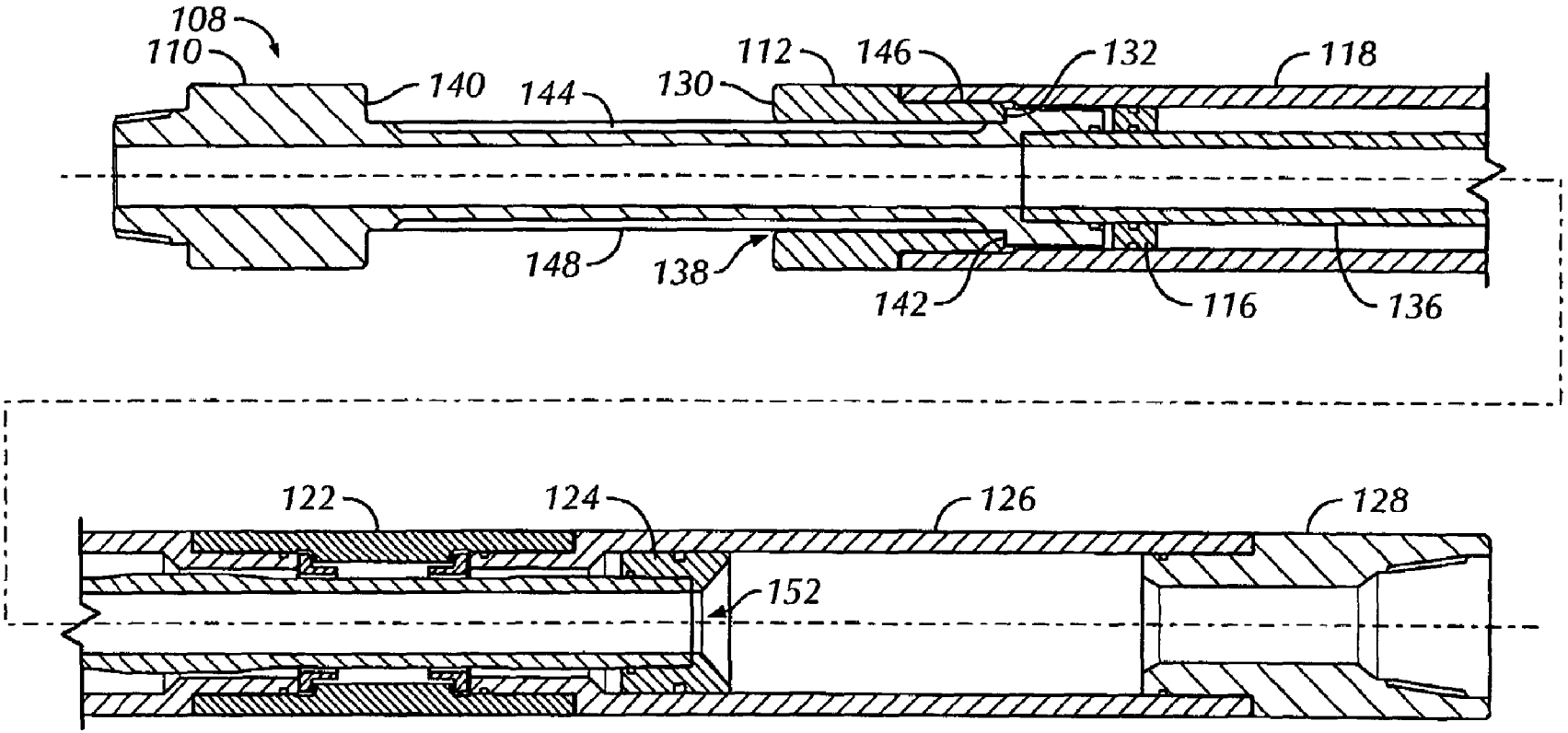
FIG. 1A is a cross-sectional view of a bi-directional jar in a first fully "fired" position.
Figure 1B:
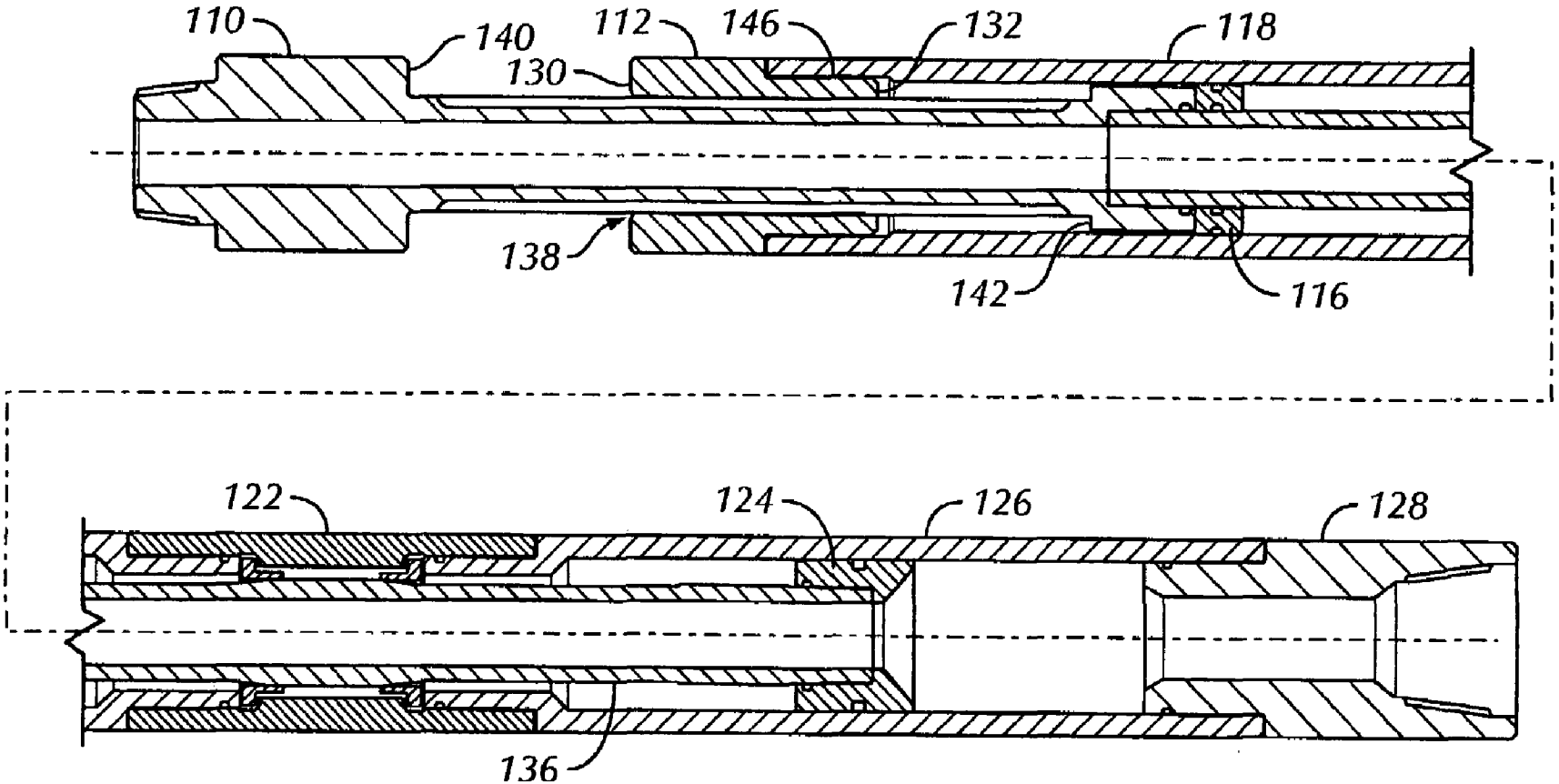
FIG. 1B is a cross-sectional view of a bi-directional jar in the "cocked"/middle position.
Figure 1C:
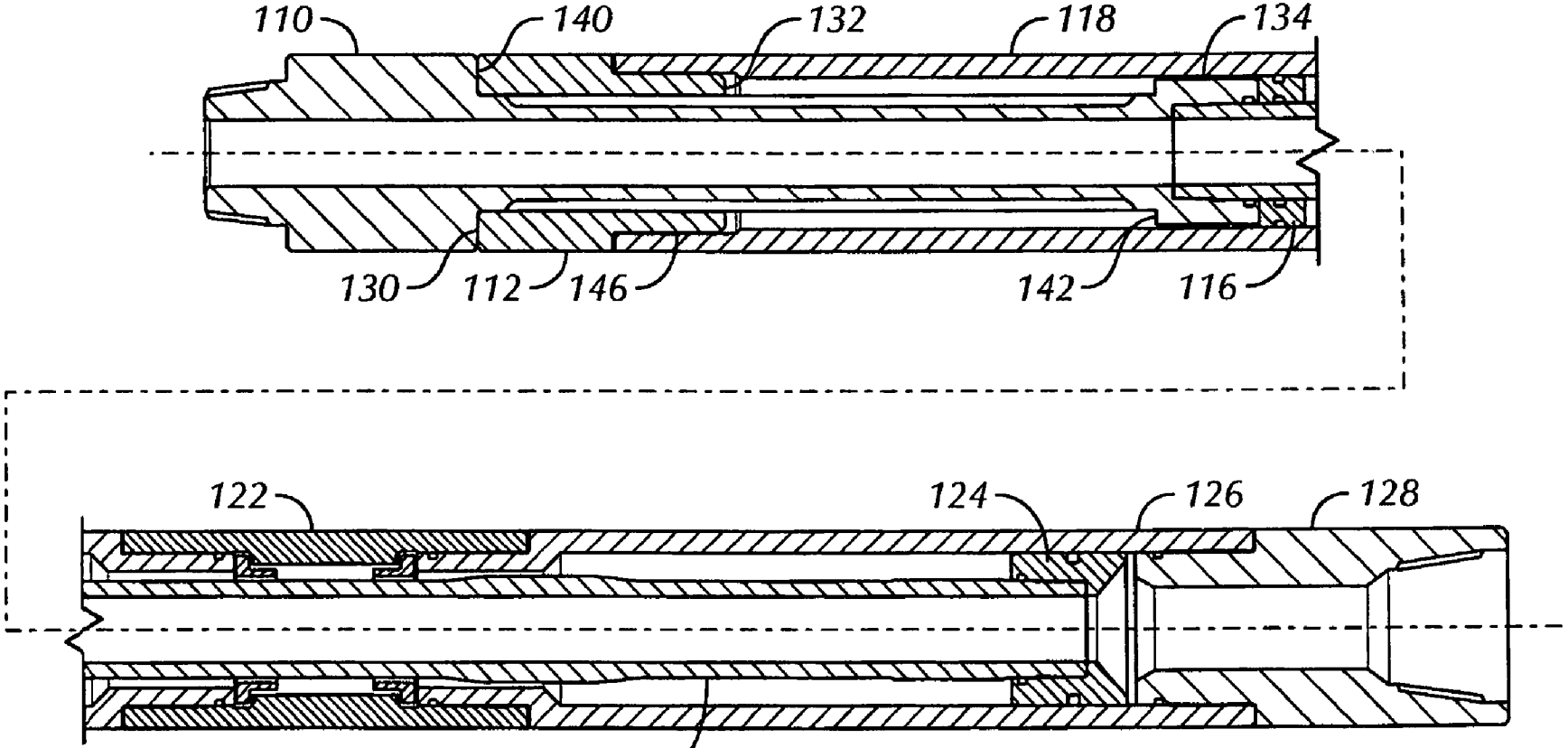
FIG. 1C is a cross-sectional view of a bi-directional jar in a second fully "fired" position.

Referring to FIGS. 1A, 1B, and 1C, three positions of one embodiment of a jar of the present invention are shown. The depicted embodiment is a multi-directional jar, meaning that it can be fired in either an upward or downward direction. Further, the preferred embodiment allows construction of a short jar. FIG. 1A shows the jar in an fully "fired" condition, as it would be positioned after the jar was fired to exert an upward force on a stuck body. FIG. 1B shows the jar in a "cocked" position. FIG. 1C shows the jar in a fully "fired" condition, as it would be positioned after firing the jar to exert a downward force.

Figure 3A:
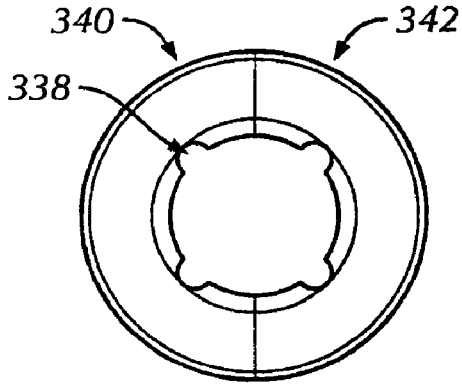
FIG. 3A is an end view of the spline body
Figure 3B:
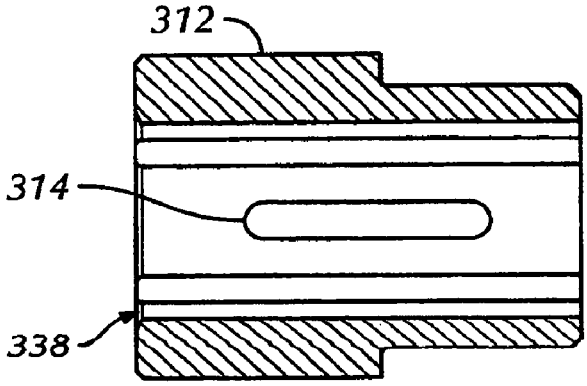
FIG. 3B is an enlarged cross-sectional view of the spline body

Referring first to FIG. 1A, the jar 108 comprises a spline body 112, a floater body 118, which is threadably connected to the spline body 112 via threading 146, a piston body 122 threadably connected to the floater body 118, and a pressure body 126 threadably connected to the piston body 122. The spline body 112 comprises a first anvil face 130 and a second anvil face 132. Referring to FIGS. 3A and 3B, the spline body 312 is shown in a larger view, and is shown to additionally comprise a plurality of spline slots 314 (only one such slot is visible due to the cross-sectional view) and vent ports 338. The vent ports 338 serve to allow fluid communication between the environment outside of the jar 108 (of FIG. 1) and the interior of the jar 108. The spline body 312 comprises two halves 340 and 342.

Referring again to FIG. 1A, the jar additionally comprises a mandrel 110 with a plurality of mandrel spline slots 144 extending parallel to the longitudinal axis of the mandrel 110. When the spline body 112 is assembled around the mandrel 110, splines (not shown) are held partially in the spline slots 314 (FIG. 3) of the spline body 112 and partially in the mandrel spline slots 144, so that the mandrel 110 is rotationally locked into position relative to the spline body 112, but slidable parallel to its longitudinal axis relative to the spline body 112. In the preferred embodiment, only two of such splines are used, but more may be used without departing from the spirit of the invention. Assembling the spline body from two halves 340 and 342 (FIG. 3) allows the mandrel/spline combination to be easily assembled by enclosing the long section 148 of the mandrel 110 within the two halves 340 and 342 of the spline body 112 before threading the spline body 112 into the floater body 118.

The jar additionally comprises a mandrel extension 136 which is preferably threadably connected to the mandrel 110. The mandrel 110 and the mandrel extension 136 are annular cylindrical bodies.

The mandrel 110 comprises a first stop 140 which, if the mandrel 110 is slid fully into the remainder of the jar assembly, will contact against the first anvil face 130 of the spline body 112. Similarly, the mandrel 110 comprises a second stop 142 which will arrest motion of the mandrel 110 in the opposite direction by contacting the second anvil face 132 of the spline body 112. When the jar is "fired," the first stop 140 or second stop 142 (depending on direction of travel) transfer the rapid relative motion of the spline body 112 to a jarring force against the mandrel 110, and thus into a fishing tool (not shown) or other tool attached to the mandrel 110.

The above-described combination of mandrel 110 and spline body 112 allows the spline body 112 and the first stop 140 and second stop 142 of the mandrel 110 to be made with a relatively large thickness of solid material around their respective annular cores, providing improved strength and durability over previously existing tools.

To allow equalization of pressure between the inside of the jar 108 and the environment outside the jar 108, the vents 138 in the spline body 112 allow fluid to enter or exit the jar 108 via the spline body 112 and around the mandrel 110 via fluid channel 134 (FIG. 1C). An annular floater 116 may be used to seal the fluid in the timing portions (discussed below) of the jar 108 from contaminants in external fluids.

Figure 2:
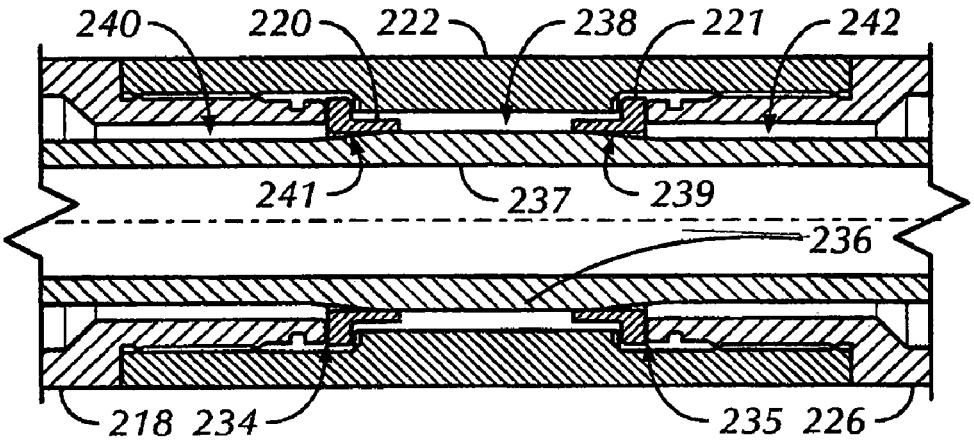
FIG. 2 is an enlarged cross-sectional view of the sliding seals on a bi-directional jar.

Referring to FIG. 2, the timing portion of the jar 108 (FIG. 1) is shown in greater detail in its "cocked" position. The jar 108 is set in this "cocked" position, from which it may be fired either up or down. FIG. 2 shows the end of the floater body 218, the piston body 222, and the end of the pressure body 226. The mandrel extension 237 extends through the annular space provided by the piston body 222. The mandrel extension 237 has a circumferential bulge 236 over a portion of its length. The bulge 236 is sufficiently large to allow selective engagement between the mandrel extension 237 and first and second sliding seals 220 and 221. First sliding seal 220 provides a fluid seal between the mandrel extension 237 and the floater body 218, and second sliding seal 221 provides a fluid seal between the mandrel extension 237 and the pressure body 226. However, first and second sliding seals 220 and 221 also comprise first and second calibrated channels 234 and 235, respectively. Thus, first sliding seal 220 provides a substantial fluid seal between annular space 238 and the floater body bore 240, but allows fluid under pressure to travel at a controlled rate via first calibrated channel 234. First calibrated channel 234 may be created by making a channel in the first sliding seal 220, or by making a channel in the floater body 218, with which the first sliding seal 220 is engaged. Similarly, second sliding seal 221 provides a substantial fluid seal between annular space 238 and the pressure body bore 242, but allows fluid under pressure to travel at a controlled rate via second calibrated channel 235. Second calibrated channel 235 may be created by making a channel in the second sliding seal 221, or by making a channel in the pressure body 226, with which the second sliding seal 221 is engaged.

Referring again to FIG. 1A at the end 152 of mandrel extension 136, nut 124 provides a seal to prevent pressure leakage from the jar mechanism. Pressure body 126 is connected to top sub 128, allowing the jar 108 to be connected via top sub 128 to another device, such as a tool string or coiled tubing for run-in to a downhole environment.

Referring again to FIG. 1 and the expanded view of FIG. 2, when the jar 108 is positioned to apply force to some object, the jar 108 will then be "fired" to effect that force. For example, any of a variety of fishing tools (not shown) which are well known in the art may be attached to the mandrel 110, and in turn be used to grab or connect to a stuck object or a working tool. When it is desirable to fire the jar 108, either upward or downward force is applied to the jar 108 via its connecting top sub 128. This force causes the piston body 222 to attempt to move relative to the mandrel extension 237, because mandrel extension 237 and mandrel 110 are held in place by being connected to the stuck object, thereby "cocking" the jar in preparation for firing it.

The amount of hydraulic pressure which builds up before the jar 108 fires (and thus the amount of force transmitted to the mandrel 110 and the stuck object) is determined by the force applied to the jar 108. The timing of the firing is controlled by the timing mechanism within the piston body 222. If the jar is being fired "upward" (that is, movement of the piston body to the right side of FIG. 2 relative to the mandrel extension 237) the motion will be resisted by the near hydraulic lock caused by the contact between first sliding seal 220 and the mandrel extension 237. However, some slow relative motion is allowed because the first calibrated channel 234 allows a small controlled flow of fluid around first sliding seal 220. This slow relative motion between first sliding seal 220 and the mandrel extension 237 will continue until the first sliding seal 220 reaches the first end 239 of bulge 236 in the mandrel extension 237. At this point, first sliding seal 220 will no longer maintain a seal, and the hydraulic pressure built up in the jar 108 will release, with a resulting very rapid impact between the second anvil face 132 of the spline body 112 and the second stop 142 of the mandrel 110.

Conversely, if the jar is being fired "downward" (that is, movement of the piston body to the left side of FIG. 2 relative to the mandrel extension 237) the motion will be resisted by the near hydraulic lock caused by the contact between second sliding seal 221 and the mandrel extension 237. However, some slow relative motion is allowed because the second calibrated channel 235 allows a small controlled flow of fluid around second sliding seal 221. This slow relative motion between second sliding seal 221 and the mandrel extension 237 will continue until the second sliding seal 221 reaches the second end 241 of bulge 236 in the mandrel extension 237. At this point, second sliding seal 221 will no longer maintain a seal, and the hydraulic pressure built up in the jar 108 will release, with a resulting very rapid impact between the first anvil face 130 of the spline body 112 and the first stop 140 of the mandrel 110.

The timing of the jar 108, and the amount of stored pressure which is released on firing and the amount of force transferred to the stuck object, is determined by the length of the bulge 236 and the rate of flow allowed through first or second calibrated channels 234 or 235, together with the amount of force applied to the jar 108 by the operator.

Referring to FIG. 4, alternative embodiments of the jar 408 are shown. These embodiments of the jar 408 are somewhat more compact than those of FIG. 1, because the jar 408 is configured to only be fired in the "upward" direction. Thus, there is a single sliding seal 420 in initial contact with the bulge 438 of the mandrel extension 436. Thus, this configuration eliminates the extra length required to allow the jar 408 to fire in either direction.

Figures 4A, 4B, 4C:
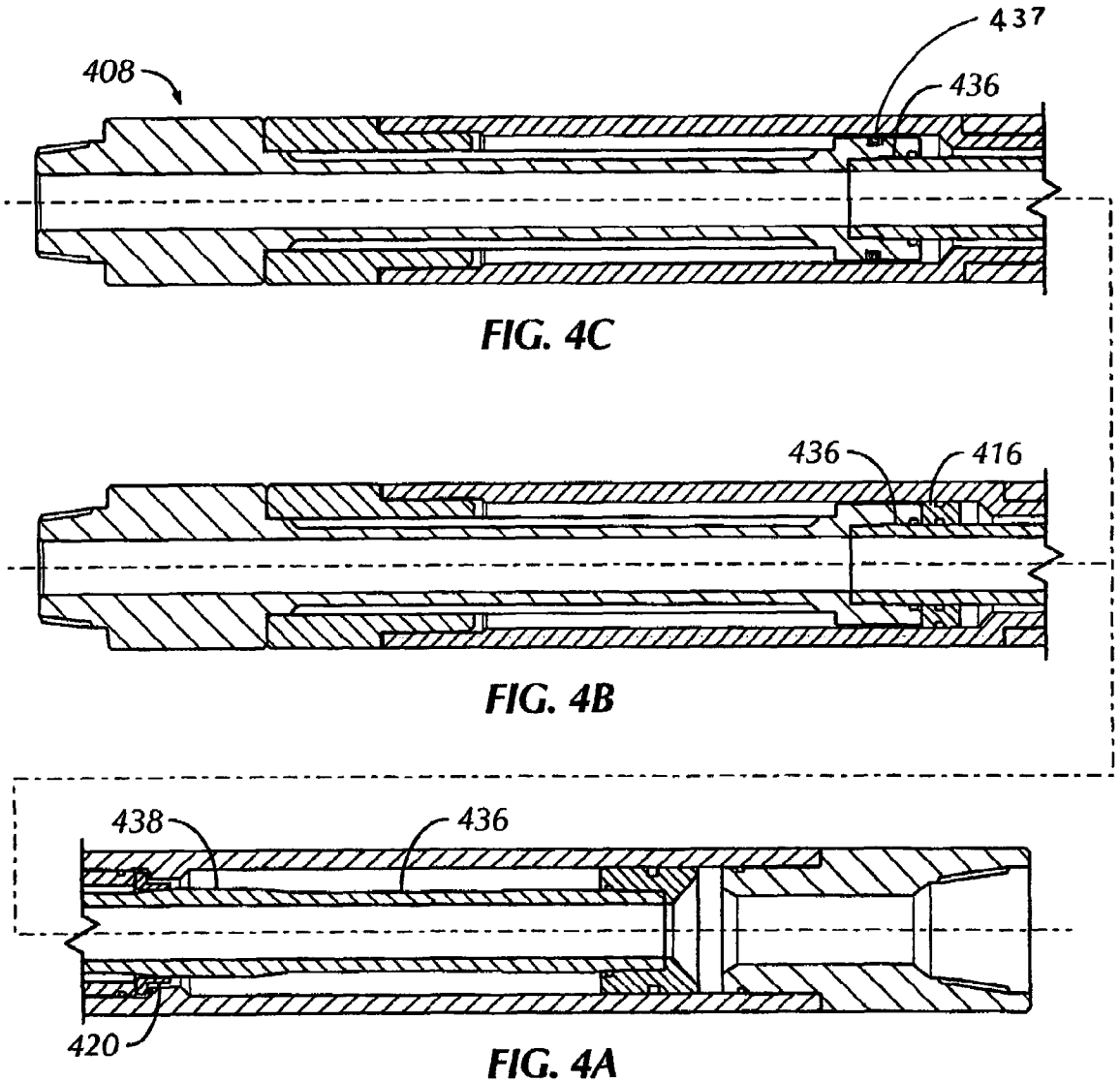
FIG. 4A is a cross-sectional view of the upper portion of an upward only jar.
FIG. 4B is a cross-sectional view of the lower portion of an upward only jar including a floater
FIG. 4C is a cross-sectional view of the lower portion of an upward only jar without a floater.

The alternative embodiments of FIGS. 4B and 4C show the jar 408 with (FIG. 4B) and without (FIG. 4C) floater 416. If no floater is used, it is necessary to supply an 0-ring seal 437 or other appropriate seal. Those of skill in the art will recognize that this alternative embodiment can also be applied to the bidirectional jar of FIG. 1. The absence of the floater 416 allows for an additional reduction in the overall length of the jar 408.

The above examples are included for demonstration purposes only and not as limitations on the scope of the invention. Other variations in the construction of the invention may be made without departing from the spirit of the invention, and those of skill in the art will recognize that these descriptions are provide by way of example only.

I claim:

1. A hydraulic timing device comprising an inner tubular member and an outer tubular member, comprising an annular space between said members, a plurality of seals, each of said seals in sealing contact with said outer tubular member and in selective sealing contact with said inner tubular member, wherein a portion of said inner tubular member is of sufficient circumference to selectively engage said seals, and a plurality of channels, wherein each of said channels allows hydraulic fluid to bypass one of said seals at a selected rate.

2. The hydraulic timing device of claim 1, wherein at least one of said seals is mounted in opposing longitudinal orientation to another of said seals.

3. The hydraulic timing device of claim 1, wherein at least one of said seals is a metal sliding seal.

4. The hydraulic timing device of claim 1, wherein at least one of said channels allows fluid to flow in the opposing longitudinal direction to another of said channels.

5. The hydraulic timing device of claim 1, wherein at least one of said seals is in physical engagement with a pressure body.

6. The hydraulic timing device of claim 5, wherein at least one of said channels is an integral part of said pressure body.

7. A hydraulic timing device comprising an inner tubular member and an outer tubular member, comprising an annular space between said members, a plurality of seals, each of said seals in sealing contact with said outer tubular member and in selective sealing contact with said inner tubular member, wherein a portion of said inner tubular member is of sufficient circumference to selectively engage said seals, and a plurality of channels, wherein each of said channels allows hydraulic fluid to bypass one of said seals at a selected rate, wherein the timing of the device is alterable by controlling the length of the portion of said inner tubular member which is of sufficient circumference to selectively engage said seals.

8. The hydraulic timing device of claim 1, wherein the timing of the device is alterable by controlling the rate of fluid flow through said channels.

9. The hydraulic timing device of claim 7, wherein at least one of said seals is mounted in opposing longitudinal orientation to another of said seals.

10. The hydraulic timing device of claim 7, wherein at least one of said seals is a metal sliding seal.

11. The hydraulic timing device of claim 7, wherein at least one of said channels allows fluid to flow in the opposing longitudinal direction to another of said channels.

12. A hydraulic timing device comprising an inner tubular member and an outer tubular member, comprising an annular space between said members, a plurality of seals, each of said seals in sealing contact with said outer tubular member and in selective sealing contact with said inner tubular member, wherein a portion of said inner tubular member is of sufficient circumference to selectively engage said seals, and a plurality of channels, wherein each of said channels allows hydraulic fluid to bypass one of said seals at a selected rate, wherein said at least one of said channels is an integral part of one of said seals.

13. The hydraulic timing device of claim 12, wherein at least one of said seals is mounted in opposing longitudinal orientation to another of said seals.

14. The hydraulic timing device of claim 12, wherein at least one of said seals is a metal sliding seal.

15. The hydraulic timing device of claim 12, wherein at least one of said channels allows fluid to flow in the opposing longitudinal direction to another of said channels.

16. The hydraulic timing device of claim 12, wherein the timing of the device is alterable by controlling the rate of fluid flow through said channels.

17. A hydraulic timing device comprising an inner tubular member and an outer tubular member, comprising an annular space between said members, a plurality of seals, each of said seals in sealing contact with said outer tubular member and in selective sealing contact with said inner tubular member, wherein a portion of said inner tubular member is of sufficient circumference to selectively engage said seals, and a plurality of channels, wherein each of said channels allows hydraulic fluid to bypass one of said seals at a selected rate, wherein said hydraulic timing device provides timing for a jar.

18. The hydraulic timing device of claim 17, wherein at least one of said seals is mounted in opposing longitudinal orientation to another of said seals.

19. The hydraulic timing device of claim 17, wherein at least one of said seals is a metal sliding seal.

20. The hydraulic timing device of claim 17, wherein at least one of said channels allows fluid to flow in the opposing longitudinal direction to another of said channels.

21. The hydraulic timing device of claim 17, wherein the timing of the device is alterable by controlling the rate of fluid flow through said channels.

22. A hydraulic timing device comprising an inner tubular member and an outer tubular member, comprising an annular space between said members, a plurality of seals, each of said seals in sealing contact with said outer tubular member and in selective sealing contact with said inner tubular member, wherein a portion of said inner tubular member is of sufficient circumference to selectively engage said seals, and a plurality of channels, wherein each of said channels allows hydraulic fluid to bypass one of said seals at a selected rate, wherein at least one of said seals is in physical engagement with a floater body.

23. The hydraulic timing device of claim 22, wherein at least one of said channels is an integral part of said floater body.

24. The hydraulic timing device of claim 22, wherein at least one of said seals is mounted in opposing longitudinal orientation to another of said seals.

25. The hydraulic timing device of claim 22, wherein at least one of said seals is a metal sliding seal.

26. The hydraulic timing device of claim 22, wherein at least one of said channels allows fluid to flow in the opposing longitudinal direction to another of said channels.

27. The hydraulic timing device of claim 22, wherein the timing of the device is alterable by controlling the rate of fluid flow through said channels.

* * * * *